US010668325B2

(12) United States Patent
Dean

(10) Patent No.: US 10,668,325 B2
(45) Date of Patent: Jun. 2, 2020

(54) METHOD AND DEVICES FOR ENHANCING SPEED, STRIDE, AND BALANCE WHILE WALKING AND/OR RUNNING

(71) Applicant: Stride Sticks, L.L.C., Marion, NC (US)

(72) Inventor: Carl Dean, Marion, NC (US)

(73) Assignee: Stride Sticks, L.L.C., Marion, NC (US)

( * ) Notice: Subject to any disclaimer, the term of this patent is extended or adjusted under 35 U.S.C. 154(b) by 146 days.

(21) Appl. No.: 15/910,298

(22) Filed: Mar. 2, 2018

(65) Prior Publication Data

US 2018/0250555 A1 Sep. 6, 2018

Related U.S. Application Data

(60) Provisional application No. 62/466,141, filed on Mar. 2, 2017.

(51) Int. Cl.

| | |
|---|---|
| ***A63B 26/00*** | (2006.01) |
| ***A63B 15/00*** | (2006.01) |
| ***A63B 22/00*** | (2006.01) |
| *A63B 21/00* | (2006.01) |
| *A63B 23/12* | (2006.01) |

(52) U.S. Cl.

CPC ..... *A63B 26/003* (2013.01); *A63B 15/00* (2013.01); *A63B 22/00* (2013.01); *A63B 21/0004* (2013.01); *A63B 21/00061* (2013.01); *A63B 21/4021* (2015.10); *A63B 23/12* (2013.01); *A63B 2022/0092* (2013.01)

(58) Field of Classification Search

CPC ..... A63B 15/00; A63B 22/00; A63B 26/003; A63B 2022/0092; A63B 21/0004; A63B 21/00058; A63B 21/00061; A63B 21/4019; A63B 21/4021; A63B 23/12; A63B 69/0028

See application file for complete search history.

(56) References Cited

U.S. PATENT DOCUMENTS

| | | | | | |
|---|---|---|---|---|---|
| 2,509,810 | A | * | 5/1950 | Core, Jr. | A63B 15/00 482/108 |
| 4,218,057 | A | * | 8/1980 | Wilson | A63B 21/0603 482/109 |
| 4,480,828 | A | * | 11/1984 | Kifferstein | A63B 23/04 446/419 |
| 4,964,630 | A | * | 10/1990 | Curtiss | A63B 21/0603 482/44 |
| 5,244,445 | A | * | 9/1993 | Amesquita | A63B 15/00 482/109 |

(Continued)

*Primary Examiner* — Megan Anderson

(57) ABSTRACT

The method for engaging a person's sensorimotor complex includes providing a pair of lightweight sticks of equal length and weight; measuring a shoulder width from a first shoulder blade acromion of the person to a second shoulder blade acromion of the person; selecting from the plurality of devices a first lightweight stick and a second lightweight stick each having a length approximately equal to the width from the first shoulder blade acromion of the person to the second shoulder blade acromion of the person; grasping the first and second lightweight sticks with a respective first and second hands at a grasping position along the stick that is one shoulder width from a distal end of the stick; swinging the first and second hands back and forth between a first position and a second position; and walking while swinging the first and second hands back and forth.

20 Claims, 9 Drawing Sheets

(56) References Cited

U.S. PATENT DOCUMENTS

| | | | | | |
|---|---|---|---|---|---|
| 5,269,528 | A * | 12/1993 | McCardle, Jr. | A63B 15/00 | 434/252 |
| 5,316,531 | A * | 5/1994 | Spence | A63B 15/00 | 482/106 |
| 5,700,229 | A * | 12/1997 | Karnofsky | A63B 69/004 | 482/83 |
| 8,038,585 | B1 * | 10/2011 | Brown, Jr. | A63B 21/0004 | 482/108 |
| 2005/0113218 | A1 * | 5/2005 | Sewitch, Jr. | A63B 15/00 | 482/99 |
| 2017/0095689 | A1 * | 4/2017 | Weck | A63B 21/0603 | |

* cited by examiner

METHOD AND DEVICES FOR ENHANCING SPEED, STRIDE, AND BALANCE WHILE WALKING AND/OR RUNNING

RELATED APPLICATION

This application claims priority to and incorporates entirely by reference U.S. Provisional Patent Application Ser. No. 62/466,141 filed on Mar. 2, 2017.

FIELD OF THE INVENTION

This invention relates to methods and devices for enhancing walking and/or running performance for persons in need of physical therapy, and for healthy persons that desire to improve performance.

BACKGROUND OF THE INVENTION

U.S. Pat. No. 5,407,410 teaches a hand-held aid for human locomotion which consists of a hand lever to be held in the hand of a person while engaged in locomotion. The hand lever is a rigid, lightweight, non-compressible device that has a first segment with a leading edge. A rear segment has a convex edge, and an intermediate segment is between the front and rear segments. The fingers of the person grip the leading edge of the front segment and press the convex edge of the rear segment of the device toward the heel of the person's hand. The top edge of the first segment is curved, and is capped by the person's thumb. The hand lever, when held by the person, aligns, intensifies, and projects the hand, forearm, and ultimately, the total body drive through space.

U.S. Pat. No. 5,316,531 teaches a hand held weighted device for aerobic exercise that includes an elongated, rigid tube having a hollow interior. A weighted mass is mounted in a portion of the hollow interior of the tube. The tube is covered with a resilient cover-piece, such as foam rubber, which is preferably divided into at least three distinct sections, each consisting of a different color, defining grasping positions to provide a selected effective weight to be lifted.

U.S. Pat. No. 4,218,057 teaches an arm exerciser for runners including a hand grip having a peripheral wall, an end wall, and a hand grip passage. A tube is received within the hand grip. A weight including metal is provided within the tube, and the outer end of the tube is closed.

U.S. Pat. No. 8,038,585 teaches a flexible elongated handheld exercise bar device intended for human use in which an exercise device is held in each hand with each exercise device bending in response to the movement of an individual's hands and arms when performing an exercise such as walking, or an aerobic exercise such as step aerobics. In addition, the flexible exercise device contains metal particles in the core of the device which will move back and forth freely inside the exercise device adding to the exercise benefits by increasing the weight and increasing resistance through the dynamic movement of the metal particles, also creating a noise that can allow an individual to achieve more benefit from an exercise, such as walking, to enhancing better coordination in the movement of one's hands and arms with the simultaneous movement of one's legs, as in walking by trying to achieve a consistent noise level during the exercise.

U.S. Pat. No. 6,234,982 teaches an apparatus and method for assessment and feedback training of step width coordination. The apparatus provides feedback training of the proper base support during gait therapy of patients with neurological disorders. The apparatus produces signals recognizable by the user in response to change in distance between legs of the user, or between the body of the user and an assistive device. The apparatus is adjustable to a desired distance between two legs, or a distance between an assistive device and the user's body, and to a particular exercise protocol.

U.S. Pat. No. 5,788,608 teaches multi-purpose exercise/sport poles with many optional attachments, and a method of exercising. An adjustable or non-adjustable exercise device is taught having at least one shaft. It is also possible to attach weights, an electronics package, an offset, or a removable tip to the exercise device.

SUMMARY OF THE INVENTION

The method of the invention is useful in pediatric physical therapy, outpatient physical therapy, home health physical therapy, and hospice physical therapy. The method of the invention can be used in accordance with sensorimotor aspects from each area of discipline to create the ways that physical therapy patients can benefit from the devices. Also, the method of the invention is beneficial to runners and walkers, especially "weekend warriors".

For example, the method of the invention can benefit a 43-year-old healthy male whose best mile time was a 10 min. Although he could run upwards of 10 miles, he could never beat the time of 10 min for completing a one mile run. The idea behind the method of the invention is "Sensorimotor Awareness Reintegration Training" (SMART). After performing the core SMART method developed for the running stride, this male ran a 6:59/mile 5K race with the stride sticks, and one week later with no stride stick he ran a 6:50/mile 5K race, thus incurring muscle memory, and thereby demonstrating that the concept of bridging the sensorimotor complex and the cerebellum of the brain into performing as if he was bigger than he actually was carried over into muscle memory, and thereby increase speed, stride, and balance.

SMART requires that the person hold a pair of "stride sticks," holding each stride stick at a point along the stick such that the hand rests at a distance from the distal end of each stride stick that is equal to the length of the shoulder width (measured from acromion to acromion) of the user. Holding each stride stick at this distance from the distal end of the stride stick causes the brain of the user to think the extension of each arm is real, thereby creating an increased walking and running stride length. Essentially, holding each stride stick in this way creates a bridge from the sensorimotor complex to the cerebellum and a sensorimotor illusion that makes one's body think that one is bigger than one actually is, and the body adapts by creating an increased stride length. The particular area of the brain is often referred to as the sensory homunculus and the motor homunculus. Together they are referred to as the sensorimotor homunculus. This area is a distorted version of what the brain thinks a person is as compared to the number of sensory neurons and motor neurons in the body. Because of the increased amount of sensory and motor neurons required in the lower aspect of the arm, the brain thinks the arm is actually longer than it really is. Therefore, holding the sticks acromion-to-acromion causes the brain to accept it based on the spatial awareness of it already knowing the shoulder measurement. That is why the measurement is crucial and why it is so effective in increasing stride, balance, and stability.

The devices include a pair of PVC pipes; and two pairs of end caps, each end cap covering an end of one of the PVC pipes. Each device is not limited to being made from PVC piping. Generally, each device needs to be a sturdy, rigid, and lightweight piece of material. Materials such as the current model PVC, light weight carbon fiber, aluminum, titanium, and wood are examples of materials that could be used to form each device.

In some embodiments, the devices further include two wrist straps, one wrist strap being attached near an end of each PVC pipe of the pair of PVC pipes.

In some embodiments, each PVC pipe is 12 inches long.

In some embodiments, each PVC pipe is 15 inches long.

In some embodiments, each PVC pipe is 18 inches long.

In some embodiments, each PVC pipe has an outer diameter of 0.75 inches.

In some embodiments, each PVC pipe has an inner diameter of 0.65 inches.

In some embodiments, the device further includes reflective tape, applied to each PVC pipe.

In some embodiments, the device further includes color tape, applied to each PVC pipe, the color being different from the PVC pipe so as to increase visual contrast.

In some embodiments, the device further includes colored tape used by a trained physical therapist, occupational therapist, physician, chiropractor, or other related professional to indicate the location on the device which the patient or client should grasp the device for the SMART method.

Benefits of the SMART method includes: (1) Helps to increase Running and Walking Stride, (2) Helps to increase Base of Support and Balance, and (3) Decreases time thus potentially burning calories.

Moreover, SMART relaxes muscles for a post workout run or walk. SMART facilitates myofascial release of sore muscles.

SMART helps to reduce and eliminate the five most common injuries for runners: Plantar fasciitis (3 Exercises and use of Stride Sticks), IT band syndrome (3-6 Exercises and use of Stride Sticks), Knee pain (3-6 Exercises and use of Stride Sticks), Achilles tendonitis (3 Exercises and use of Stride Sticks), and Shin splints (3 Exercises and use of Stride Sticks).

BRIEF DESCRIPTION OF THE DRAWINGS

The invention will be more fully understood from the following Detailed Description, in conjunction with the following figures, wherein.

DETAILED DESCRIPTION OF THE PREFERRED EMBODIMENTS

Figure 1A:
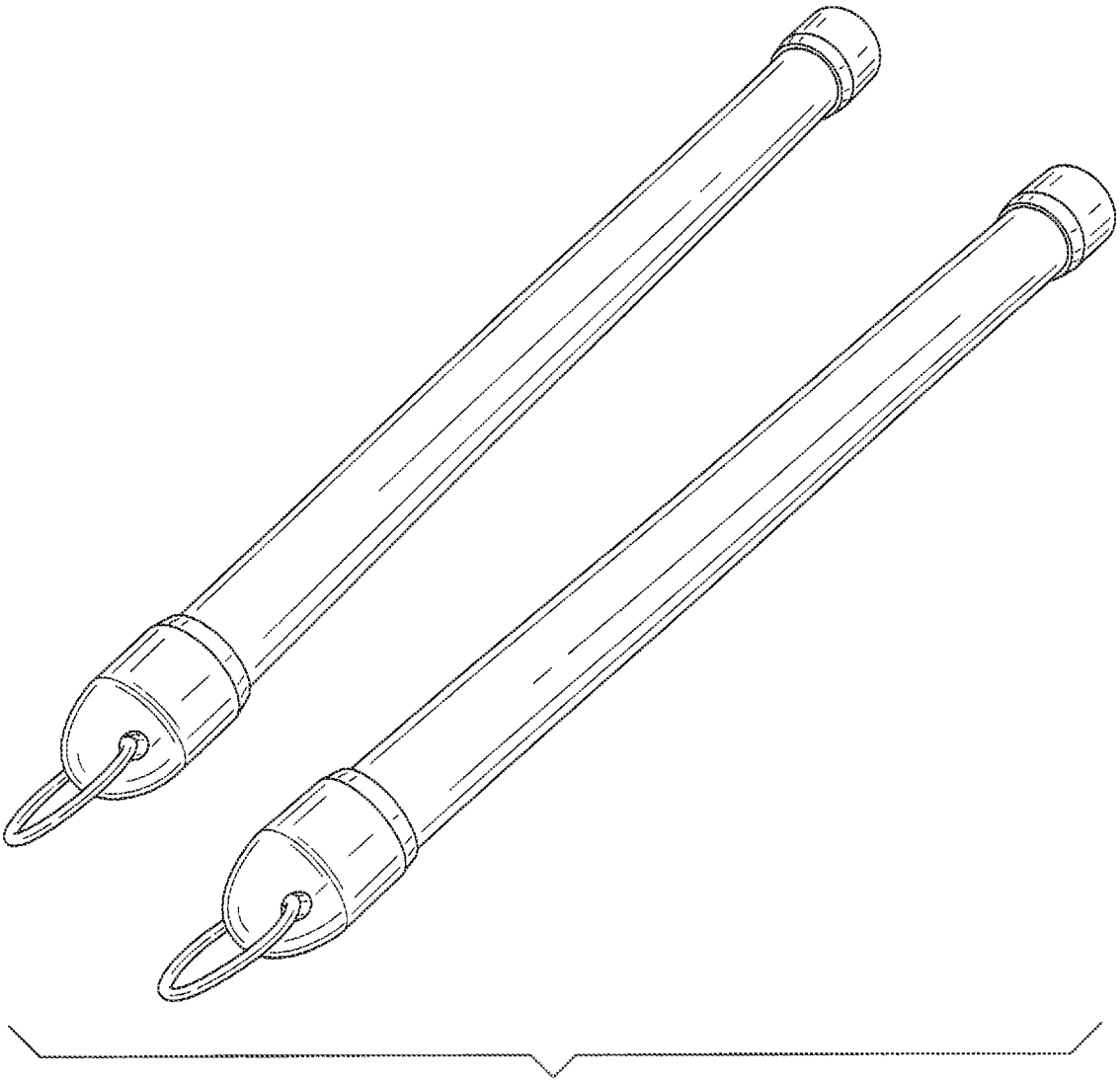
FIG. 1A is a perspective view of the lightweight stick of the device of the present invention.
Figure 1B:
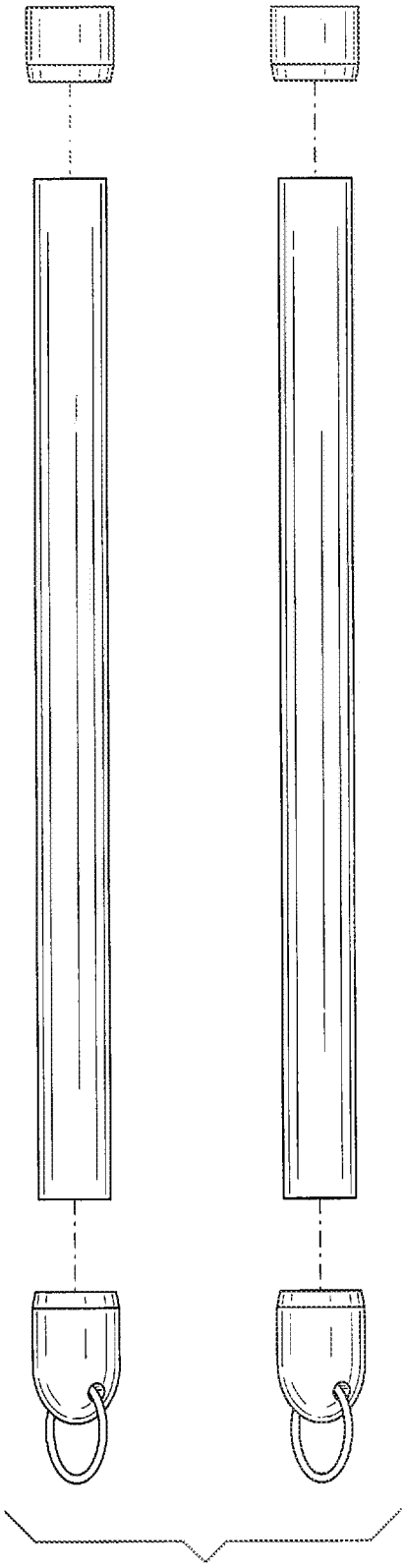
FIG. 1B is an exploded side elevational view of the lightweight stick of the device of the present invention.

Sensorimotor Awareness Reintegration Training (SMART) is a method that preferably uses specialized devices (herein called "Stride Sticks") using specific body measurements of the user, stride stick sensorimotor exercises, proprioception exercises, and specific stretches, to engage the sensorimotor system of the brain so as to increase stride, balance, stability, and mobility.

Everyone is affected by the aging process; bodies degrade and so do abilities. SMART helps to engage body awareness utilizing personal measurements of a person, thereby making the person safer, more balanced, and enhancing the person's understanding of where their body is in space and time. Due to the aging process, one's stride gets smaller, and as one's stride gets smaller over the years, the person experiences a decrease in balance, and an increase in the risk of falling. Thus, as the stride gets smaller, the sensorimotor complex decreases, which increases the risk of falls.

The sensorimotor complex is the combination of the sensory system of the brain and the motor system of the brain coming together to interpret and manage where the body is in space and time. The visual system, the vestibular system, and the proprioceptive system are fundamentally critical to balance. The vestibular system is the sensory system that provides the leading contribution to the sense of balance and spatial orientation for the purpose of coordinating movement with balance. The visual system gives a picture to the person where they are in space in time, the vestibular system tells the body where it is going, and the proprioceptive system helps the limbs, hands, and feet to feel relative position, and feel contact with the ground. Bringing those senses together simultaneously with the motor system so as to create the motion of the body is what enables the body to go where it needs to go.

The easiest way to understand the sensorimotor complex is to visualize an imaginary bubble that surrounds a person, that imaginary bubble being created by a combination of the required senses needed for balance, and the motor system required for moving, working together to determine outer limits of the bubble that we are safely able to maintain for balance, coordination, and upright position without falling.

As a child learns to walk, the sensorimotor bubble is very small. However, as a child grows, the sensorimotor bubble of the child grows too. Once the individual stops growing, the bubble will also stop growing, and will reach its maximum outer limits. Over time those maximum outer limits decrease due to age, injuries, conditions/diagnosis, and/or any sensory or motor disturbance created in life. No matter what, it is normal for that bubble to decrease as a person ages.

SMART uses a measurement derived from a feature of the individual's body that the sensorimotor complex accepts readily (assuming that no adverse neurological event has occurred), due to longstanding consistency in this specific measurement of the body. In contrast to the method of SMART, many people choose to walk holding weights, and what usually occurs is that the individual will bend at the elbow more and hold the weight closer to their body. This in turn decreases the stride length, and increases pressure on the hips, knees, ankles, and feet. Thus, walking with hand weights causes the sensorimotor bubble to shrink.

Figure 2:
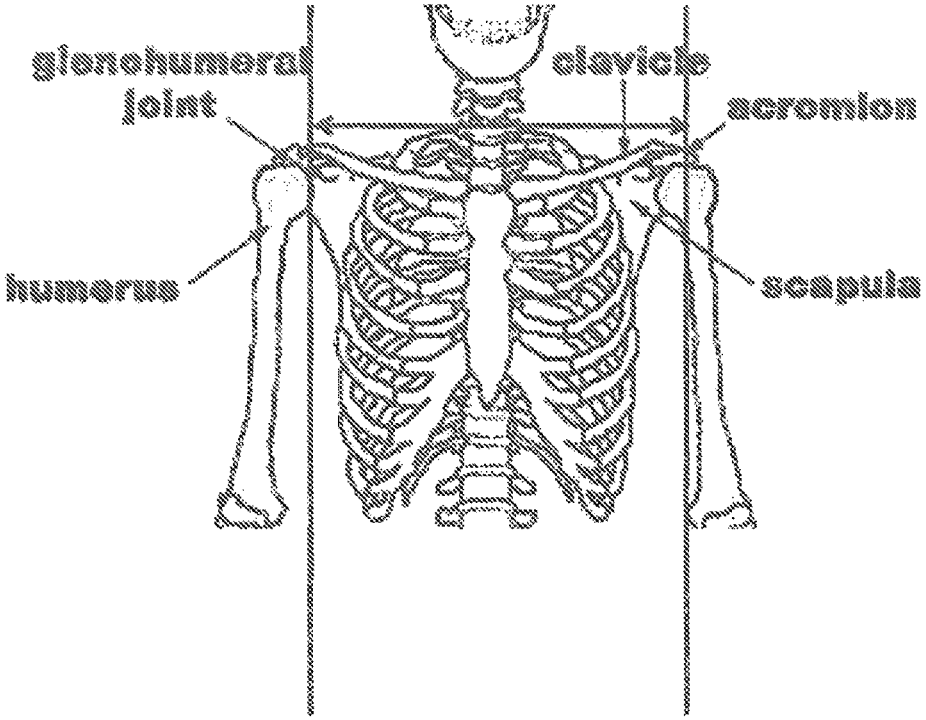
FIG. 2 is a side elevational view illustrating measurement points for determining the length approximately equal to the width from the first shoulder blade acromion of a person to the second shoulder blade acromion of a person.
Figure 3:
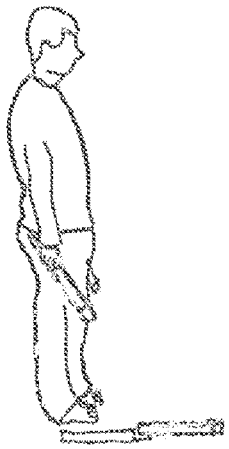
FIGS. 3-19 are side elevational views of a user illustrating the methods of use of the device of the present invention by a person for physical therapy purposes.
Figure 4:
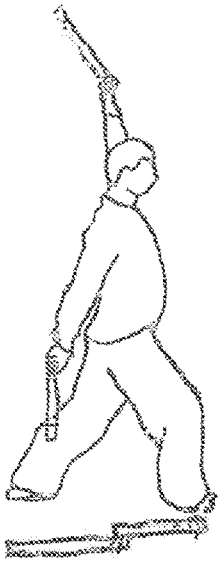
Figure 5:
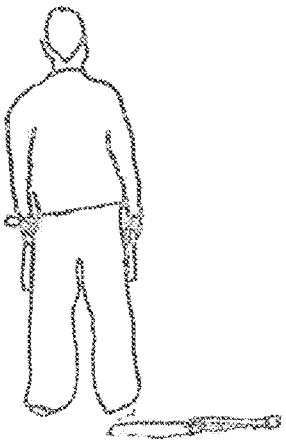
Figure 6:
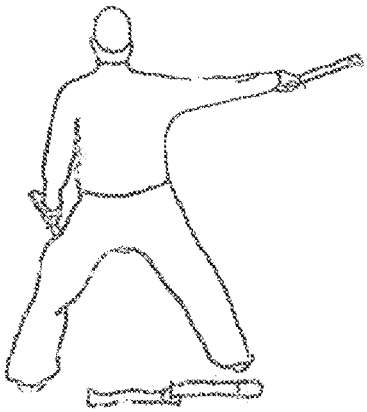
Figure 9:
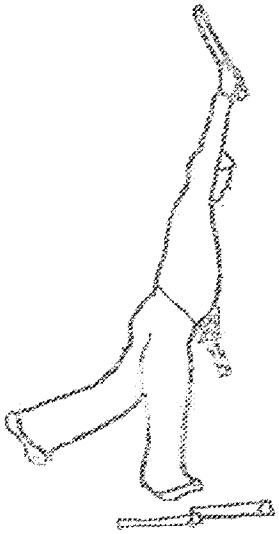
Figure 8:
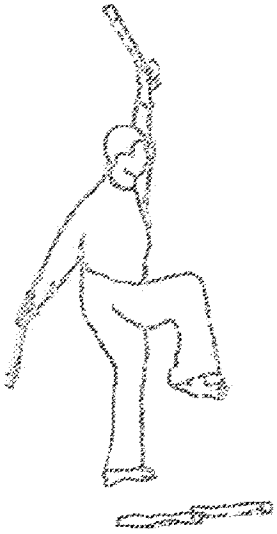
Figure 7:
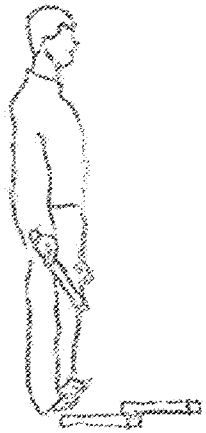
Figure 11:
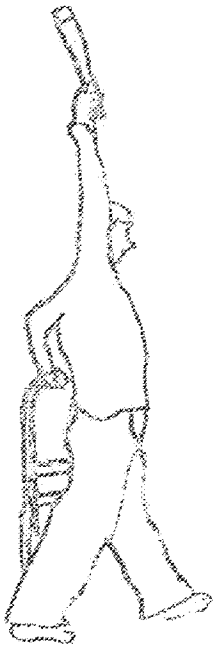
Figure 10:
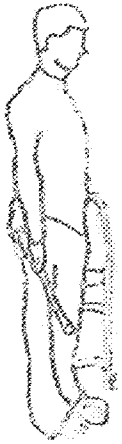
Figure 12:
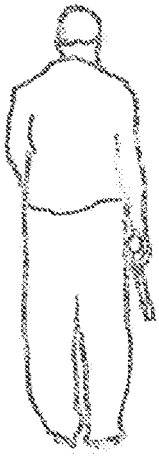
Figure 13:
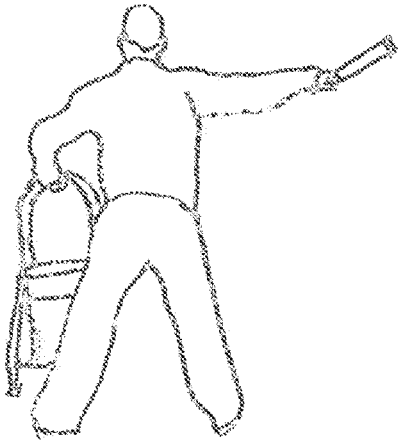
Figure 14:
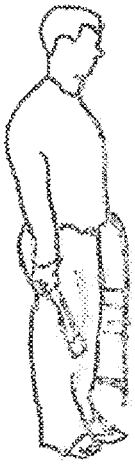
Figure 15:
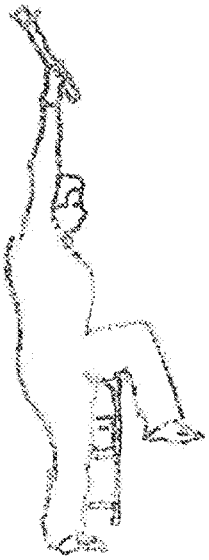
Figure 17:
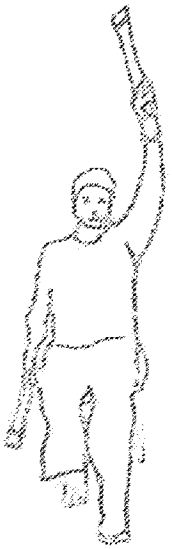
Figure 16:
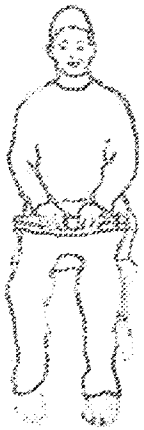
Figure 18:
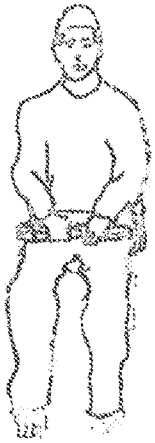
Figure 19:
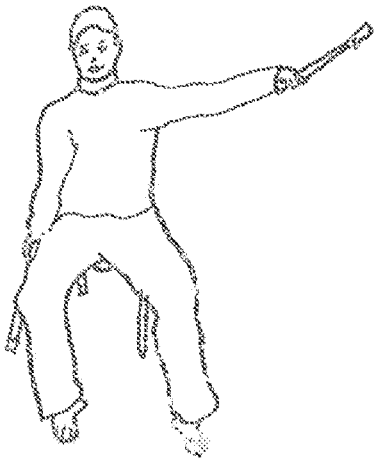

SMART uses a measurement of the shoulder width to determine where along a stride stick to hold the stride stick. Thus, the place along a stride stick that the user grasps is specific to the individual's shoulder width (measured from acromion to acromion, as shown in FIG. 2). By holding the stride sticks during ambulation (walking), the sensorimotor bubble is enlarged, and coupled with the sensorimotor exercises listed below—along with the balance and specific stretches, the enlarged sensorimotor bubble is maintained by the body, accepted into muscle memory, thereby lengthening stride, which increases balance.

Once muscle memory has achieved been achieved, and the person is operating at the highest functional level possible, they no longer need to ambulate (walk) using the stride sticks, and perform other exercises using the stride sticks. However, it is highly recommended to continue to use the stride sticks regularly, from a medical standpoint, due to the aging process and the continual degradation of the sensorimotor complex. All individuals are encouraged to continue with the use of the stride sticks due to the multiplicity of uses, and to continue to use the exercises and stretches.

SMART is from the above mentioned broken into 4 simple phases

Phase 1: Where you are now, i.e., as we age the sensorimotor complex (bubble) decreases with age, diagnosis, and or nuroerogical/orthopedic injury, thereby causing decrease in stride, balance, and mobility.

Phase 2: Bridging the sensory and motor cortices of the brain with the use of stride sticks and baseline measurement of acromion to acromion. Thereby increasing stride, balance, and mobility by immolating the sensorimotor homunculus of the brain, causing the brain to think that you are bigger than you really are.

Phase 3: Stride Sticks running/walking along with the targeted exercises in SMART to extend the body from the flexed position to the extended position.

Phase 4: Muscle memory accepts the new adjustments you your body and you walk and run with increased stride, balance, and mobility.

Stride Sticks are the main device used to initially engage the sensorimotor complex. Stride Sticks include two sticks, each being round and of an outer diameter of ¾", and being as light in weight as possible. Stride Sticks can be made from plastic (e.g., PVC), light weight carbon fiber, aluminum, titanium, or any light weight material. The length of each device can range generally from 12-18 inches, and the average length that is usable by most individuals is 15 inches. Each of the Stride Sticks is equal in length and weight to the other. Initial and most effective measurement for hand placement distance from the distal end of the Stride Stick is the length of the individual's shoulder width (measured from acromion to acromion, as seen in FIG. 2) along each stride stick, such that each stride stick is held such that it extends one shoulder width beyond the hand.

Adjustment can be altered if the individual has a history of any neurological incident (i.e., Cerebral Vascular Accident, Parkinson's Disease, Trans Ischemic Accident) or orthopedic/musculoskeletal injury.

The appropriate measurement is determined utilizing the stride stick. The lead edge of a stride stick is placed on the boney prominence of the acromion (see FIG. 2) and the opposite hand locates the opposite acromion and addresses the location along the stick. This helps to provide the sensorimotor basis for retraining and integrating the sensorimotor complex. This is the same initial measurement used for individuals that want to increase their stride length for running and for walking. Additionally, this is the same measurement used by a therapist for determining and initiating gait training for individuals with balance deficits. Individuals are then instructed to focus primarily on arm swing, and to ambulate (walk) using opposite arm and leg.

In accordance with one embodiment, the method for engaging a person's sensorimotor complex so as to enhance speed, stride, and balance while walking or running includes the following steps: (1) providing a plurality of devices, each of the devices including a pair of lightweight sticks of equal length and weight; (2) measuring a shoulder width from a first shoulder blade acromion of the person to a second shoulder blade acromion of the person; (3) selecting from the plurality of devices a first lightweight stick and a second lightweight stick each having a length approximately equal to the width from the first shoulder blade acromion of the person to the second shoulder blade acromion of the person; (4) grasping the first lightweight stick with a first hand at a grasping position along the stick that is one shoulder width from a distal end of the stick; (5) grasping the second lightweight stick with a second hand at a grasping position along the stick that is one shoulder width from a distal end of the stick; (6) swinging the first hand back and forth between a first position and a second position, while swinging the second hand back and forth opposite to the swinging of the first hand; and (7) walking while swinging the first and second hands back and forth, and while the first and second hands grasp the first and second lightweight sticks, respectively. In one embodiment, the pair of lightweight sticks are a pair of lightweight hollow cylinders each including two pairs of end caps, each end cap covering an end of one of the lightweight hollow cylinders, and two wrist straps, one wrist strap being attached near an end of each lightweight hollow cylinder of the pair of light-weight hollow cylinders.

In accordance with another embodiment, the method for engaging a person's sensorimotor complex so as to enhance speed, stride, and balance while walking or running includes the following steps: (1) measuring a shoulder width from a first shoulder blade acromion of the person to a second shoulder blade acromion of the person; (2) grasping a first lightweight stick with a first hand at a grasping position along the stick that is one shoulder width from a distal end of the stick; (3) grasping a second lightweight stick with a second hand at a grasping position along the stick that is one shoulder width from a distal end of the stick; (4) swinging the first hand back and forth between a first position and a second position, while swinging the second hand back and forth opposite to the swinging of the first hand; and (5) walking while swinging the first and second hands back and forth, and while the first and second hands grasp the first and second lightweight sticks, respectively.

In one embodiment, walking while swinging the first and second hands back and forth, includes moving forward the foot on the side opposite the first hand while the first hand swings forward; and moving forward the foot on the side opposite the second hand while the second hand swings forward.

In one embodiment, when the person has a neurological disorder, the method includes moving the grasping position of the first hand along the stick to half the shoulder width from the distal end of the stick, and moving the grasping position of the second hand along the stick to half the shoulder width from the distal end of the stick. An additional step may be provided, wherein the grasping position for each stick is gradually increased in distance as the neurological disorder improves, from one half the shoulder width from the distal end of the stick, to one full shoulder width from the distal end of the stick.

In one embodiment, walking while swinging the first and second hands back and forth includes moving forward two shoulder widths the foot on the side opposite the first hand while the first hand swings forward; and moving forward two shoulder widths the foot on the side opposite the second hand while the second hand swings forward. An additional step may be provided, wherein if the person is unable to move the foot forward two shoulder widths on the side opposite the first hand, then start moving the foot forward one shoulder width, and gradually increase to two shoulder widths. Still another step may be provided, wherein if the person is unable to move the foot forward one shoulder width on the side opposite the first hand, then start moving the foot forward one-half shoulder width, and gradually increase to one shoulder width.

In one embodiment, swinging the first hand back and forth between a first position and a second position, while swinging the second hand back and forth opposite to the swinging of the first hand, and walking while swinging the first and second hands back and forth, while the first and second hands grasp the first and second lightweight sticks, respectively, is performed 14 or 15 times in each direction for a total of 28 to 30 times.

In one embodiment, swinging the first hand back and forth between a first position and a second position includes raising the first lightweight stick high above the person's head while pointing the first lightweight stick generally upward, and then lowering the first lightweight stick fully downward while pointing the first lightweight stick generally downward, and swinging the second hand back and forth between a first position and a second position includes lowering the second lightweight stick and pointing generally downward while the first lightweight stick is raised, and raising the second lightweight stick and pointing it generally upward while the first lightweight stick is lowered. Another step may be provided, including raising an opposite knee while raising the first lightweight stick, and raising an opposite knee when raising the second lightweight stick and/or extending an opposite leg backwards while raising the first lightweight stick, and extending an opposite leg backwards when raising the second lightweight stick.

In one embodiment, walking while swinging the first and second hands back and forth, and while the first and second hands grasp the first and second lightweight sticks, respectively, is modified such that instead of the second hand swinging back and forth while grasping the second lightweight stick, the second hand slidingly grasps along a rail, grasps a chair, or grabs a corner of a kitchen counter to help with balance and stability. Another step may be provided, wherein swinging the first hand back and forth between a first position and a second position involves swinging the first hand back and forth between a downward position and an upstretched position and/or swinging the first hand back and forth outward between a downward position and an outstretched position.

In one embodiment, walking while swinging the first and second hands back and forth is modified such that the person assumes a sitting position, and the person exaggerates swinging the first hand and the second hand, and raises each foot upward instead of moving it forward.

In one embodiment, walking while swinging the first and second hands back and forth is modified such that the person assumes a sitting position, and the person swings the first hand outward while stepping outward with the foot on the same side as the first hand, and then swings the second hand outward while stepping outward with the foot on the same side as the second hand.

In one embodiment, swinging the first hand back and forth between a first position and a second position involves swinging the first hand back and forth between a downward position and an outstretched position, while also stepping out sideways with the foot on the same side as the first hand, as the first hand swings out to the outstretched position, and after swinging the first hand back and forth between the first position and the second position, swinging the second hand back and forth between a downward position and an outstretched position, while also stepping out sideways with the foot on the same side as the second hand, as the second hand swings out to the outstretched position, wherein stepping out sideways with the first hand, and then stepping out sideways with the second hand, replaces walking while swinging the first and second hands back and forth.

In one embodiment, walking while swinging the first and second hands back and forth, and while the first and second hands grasp the first and second lightweight sticks, respectively, is modified such that instead of the second hand swinging back and forth while grasping the second lightweight stick, the second hand slidingly grasps along a rail, grasps a chair, or grabs a corner of a kitchen counter to help with balance and stability, and wherein swinging the first hand back and forth between a first position and a second position involves: swinging the first hand back and forth between a downward position and an upstretched position, while raising an opposite knee each time the first hand swings into the upstretched position.

Other modifications and implementations will occur to those skilled in the art without departing from the spirit and the scope of the invention as claimed. Accordingly, the above description is not intended to limit the invention, except as indicated in the following claims.

What is claimed is:

1. A method for engaging a person's sensorimotor complex so as to enhance speed, stride, and balance while walking or running, the method comprising:

providing a plurality of pairs of devices, each pair of the plurality of pairs including a pair of lightweight sticks of equal length and weight; wherein each of the pair of lightweight sticks comprises a lightweight hollow cylinders; two end caps, each end cap of the two end caps covering a respective end of the lightweight hollow cylinder;

measuring a shoulder width from a first shoulder blade acromion of a person to a second shoulder blade acromion of the person;

selecting from the plurality of pairs of devices a first lightweight stick and a second lightweight stick each having a length approximately equal to the shoulder width of the person;

grasping the first lightweight stick with a first hand at a grasping position along the first lightweight stick that is one shoulder width from a distal end of the first lightweight stick;

grasping the second lightweight stick with a second hand at a grasping position along the second lightweight stick that is one shoulder width from a distal end of the second lightweight stick;

swinging the first hand back and forth between a first position and a second position, while swinging the second hand back and forth opposite to the swinging of the first hand; and walking while swinging the first and second hands back and forth, and while the first and second hands grasp the first and second lightweight sticks, respectively.

2. The method of claim 1, wherein each of the pair of lightweight sticks further comprises: a wrist straps, the wrist strap being attached near an end of the lightweight hollow cylinder.

3. A method for engaging a person's sensorimotor complex so as to enhance speed, stride, and balance while walking or running, the method comprising:

measuring a shoulder width from a first shoulder blade acromion of a person to a second shoulder blade acromion of the person;

grasping a first lightweight stick with a first hand at a grasping position along the first lightweight stick that is one shoulder width from a distal end of the first lightweight stick;

grasping a second lightweight stick with a second hand at a grasping position along the second lightweight stick that is one shoulder width from a distal end of the second lightweight stick;

swinging the first hand back and forth between a first position and a second position, while swinging the second hand back and forth opposite to the swinging of the first hand; and walking while swinging the first and second hands back and forth, and while the first and second hands grasp the first and second lightweight sticks, respectively; each of the first and second lightweight stick comprising a lightweight hollow cylinder and two end caps, wherein each end cap of the two end caps covering a respective end of the lightweight hollow cylinder.

4. The method of claim 3, wherein walking while swinging the first and second hands back and forth includes:

moving forward a distance equal to two shoulder widths the foot on the side opposite the first hand while the first hand swings forward; and moving forward a distance equal to two shoulder widths the foot on the side opposite the second hand while the second hand swings forward.

5. The method of claim 4, wherein if the person is unable to move the foot forward the distance equal to two shoulder widths on the side opposite the first hand, then the persons starts moving the foot forward a distance equal to one shoulder width, and gradually increases to the distance of two shoulder widths.

6. The method of claim 5, wherein if the person is unable to move the foot forward the distance equal to one shoulder width on the side opposite the first hand, then the person starts moving the foot forward a distance equal to one half shoulder width, and gradually increases to the distance of one shoulder width.

7. The method of claim 3, wherein swinging the first hand back and forth between the first position and the second position includes raising the first lightweight stick high above the person's head while pointing the first lightweight stick upward, and then lowering the first lightweight stick fully downward while pointing the first lightweight stick downward, and wherein swinging the second hand back and forth between the first position and the second position includes lowering the second lightweight stick and pointing downward while the first lightweight stick is raised, and raising the second lightweight stick and pointing it upward while the first lightweight stick is lowered.

8. The method of claim 7, further including:

raising a first knee, the first knee being opposite to the first hand raising the first lightweight stick, and raising an opposite knee when the second hand is raising the second lightweight stick.

9. The method of claim 7, further including:

extending a first leg backwards while raising the first lightweight stick, the first leg being opposite to the first hand raising the first lightweight stick, and extending an opposite leg backwards when the second hand is raising the second lightweight stick.

10. The method of claim 3, wherein walking while swinging the first and second hands back and forth, and while the first and second hands grasp the first and second lightweight sticks, respectively, is modified such that:

instead of the second hand swinging back and forth while grasping the second lightweight stick, the second hand slidingly grasps along a rail, grasps a chair, or grabs a corner of a kitchen counter to help with balance and stability.

11. The method of claim 10, wherein swinging the first hand back and forth between the first position and the second position involves:

swinging the first hand back and forth between a downward position and an upstretched position.

12. The method of claim 10, wherein swinging the first hand back and forth between the first position and the second position involves:

swinging the first hand back and forth outward between a downward position and an outstretched position.

13. The method of claim 3, wherein when the person has a neurological disorder, moving the grasping position of the first hand along the first lightweight stick to half the shoulder width from the distal end of the first lightweight stick, and moving the grasping position of the second hand along the second lightweight stick to half the shoulder width from the distal end of the second lightweight stick.

14. The method of claim 13, wherein the grasping position for each of the first and second lightweight sticks is gradually increased in distance as the neurological disorder improves, from one half the shoulder width from the distal end of the respective lightweight stick, to one full shoulder width from the distal end of the respective lightweight stick.

15. The method of claim 3, wherein walking while swinging the first and second hands back and forth, includes:

moving forward the foot on the side opposite the first hand while the first hand swings forward; and moving forward the foot on the side opposite the second hand while the second hand swings forward.

16. A method for engaging a person's sensorimotor complex so as to enhance speed, stride, and balance while walking or running, the method comprising:

measuring a shoulder width from a first shoulder blade acromion of a person to a second shoulder blade acromion of the person;

grasping a first lightweight stick with a first hand at a grasping position along the first lightweight stick that is one shoulder width from a distal end of the first lightweight stick;

grasping a second lightweight stick with a second hand at a grasping position along the second lightweight stick that is one shoulder width from a distal end of the second lightweight stick; each of the first and second lightweight stick comprising a lightweight hollow cylinder and two end caps, wherein each end cap of the two end caps covering a respective end of the lightweight hollow cylinder;

swinging the first hand back and forth between a first position and a second position, while swinging the second hand back and forth opposite to the swinging of the first hand; and one of the following actions: assuming a sitting position; stepping out sideways; or raising an opposite knee.

17. The method of claim 16, wherein:

the person assumes a sitting position, and the person exaggerates swinging the first hand and the second hand, and raises each foot upward in turn.

18. The method of claim 16, wherein:

the person assumes the sitting position, and the person swings the first hand outward while moving outward a foot on the same side as the first hand, and then swings the second hand outward while moving outward a foot on the same side as the second hand.

19. The method of claim 16, wherein the first position is a downward position and the second position is an outstretched position, and wherein swinging the first hand back and forth between the first position and the second position involves swinging the first hand back and forth between the downward position and the outstretched position, while also stepping out sideways with a foot on the same side as the first hand, as the first hand swings out to the outstretched position, and after swinging the first hand back and forth between the first position and the second position, swinging the second hand back and forth between the downward position and the outstretched position, while also stepping out sideways with a foot on the same side as the second hand, as the second hand swings out to the outstretched position.

20. The method of claim 16, wherein the first position is a downward position and the second position is an upstretched position, and wherein:

the second hand slidingly grasps along a rail, grasps a chair, or grabs a corner of a kitchen counter to help with balance and stability, and wherein swinging the first hand back and forth between the first position and the second position involves: swinging the first hand back and forth between the downward position and the upstretched position, while raising the opposite knee each time the first hand swings into the upstretched position.

* * * * *